US010891966B2

(12) United States Patent
Maezawa

(10) Patent No.: US 10,891,966 B2
(45) Date of Patent: Jan. 12, 2021

(54) AUDIO PROCESSING METHOD AND AUDIO PROCESSING DEVICE FOR EXPANDING OR COMPRESSING AUDIO SIGNALS

(71) Applicant: Yamaha Corporation, Shizuoka (JP)

(72) Inventor: Akira Maezawa, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 103 days.

(21) Appl. No.: 16/135,818

(22) Filed: Sep. 19, 2018

(65) Prior Publication Data

US 2019/0019525 A1 Jan. 17, 2019

Related U.S. Application Data

(63) Continuation of application No. PCT/JP2017/011375, filed on Mar. 22, 2017.

(30) Foreign Application Priority Data

Mar. 24, 2016 (JP) ..... 2016-060425

(51) Int. Cl.
*G10L 21/04* (2013.01)
*G10L 21/01* (2013.01)
(Continued)

(52) U.S. Cl.
CPC ..... *G10L 21/01* (2013.01); *G10L 21/04* (2013.01); *G10L 25/03* (2013.01); *G10L 25/06* (2013.01); *G10L 25/51* (2013.01)

(58) Field of Classification Search
USPC ..... 704/200–232, 500–504
See application file for complete search history.

(56) References Cited

U.S. PATENT DOCUMENTS 5,083,310 A * 1/1992 Drory ..... G11B 20/00007 375/245
5,375,189 A * 12/1994 Tsutsui ..... H04B 1/665 704/205

(Continued)

FOREIGN PATENT DOCUMENTS

JP S59-82608 A 5/1984
JP 2000-276169 A 10/2000

(Continued)

OTHER PUBLICATIONS

International Search Report in PCT/JP2017/011375 dated Jun. 13, 2017.

*Primary Examiner* — Jesse S Pullias
(74) *Attorney, Agent, or Firm* — Global IP Counselors, LLP

(57) ABSTRACT

An audio processing device includes a feature extraction unit and signal generating unit. The feature extraction unit is configured to extract a feature quantity of a first audio signal for each of a plurality of periods. The signal generating unit is configured to for generate a second audio signal by time axis expanding/compressing either a section of the first audio signal in which the feature quantity is steadily maintained for a period time, or a section of the first audio signal in which a fluctuation of the feature quantity is repeated and excluding from the time axis expanding/compressing a section of the first audio signal in which a fluctuation of the feature quantity is not similar to that of other sections of the first audio signal.

17 Claims, 5 Drawing Sheets

(51) Int. Cl.

| | |
|---|---|
| ***G10L 25/51*** | (2013.01) |
| ***G10L 25/03*** | (2013.01) |
| ***G10L 25/06*** | (2013.01) |

(56) References Cited

U.S. PATENT DOCUMENTS

| | | | | | |
|---|---|---|---|---|---|
| 5,579,434 | A * | 11/1996 | Kudo | G10L 19/06 | 704/219 |
| 5,873,065 | A * | 2/1999 | Akagiri | G11B 20/00007 | 704/500 |
| 6,915,241 | B2 * | 7/2005 | Kohlmorgen | G06K 9/6228 | 700/102 |
| 7,010,491 | B1 * | 3/2006 | Kikumoto | G10L 21/04 | 381/106 |
| 2004/0122662 | A1 * | 6/2004 | Crockett | G10L 21/04 | 704/200.1 |

FOREIGN PATENT DOCUMENTS

| | | | |
|---|---|---|---|
| JP | 2006-017900 | A | 1/2006 |
| JP | 2008-209447 | A | 9/2008 |
| JP | 2009-181044 | A | 8/2009 |

* cited by examiner

AUDIO PROCESSING METHOD AND AUDIO PROCESSING DEVICE FOR EXPANDING OR COMPRESSING AUDIO SIGNALS

CROSS-REFERENCE TO RELATED APPLICATIONS

This application is a continuation application of International Application No. PCT/JP2017/011375, filed Mar. 22, 2017, which claims priority to Japanese Patent Application No. 2016-060425 filed in Japan on Mar. 24, 2016. The entire disclosures of International Application No. PCT/JP2017/011375 and Japanese Patent Application No. 2016-060425 are hereby incorporated herein by reference.

BACKGROUND

Technological Field

The present invention relates to technology for processing audio signals.

Background Technology

Time stretching technology for expanding/compressing (expanding or compressing) audio signals while maintaining the pitch and sound quality (for example, phonemes) has been proposed in the prior art. For example, Japanese Laid-Open Patent Application No. 2006-17900 (Patent Document 1) discloses technology to expand/compress audio signals on a time axis by means of decimation or interpolation, using a processing frame length that corresponds to the pitch of the audio signal as the unit.

SUMMARY

However, for example, if transient sections such as a glissando, in which the acoustic characteristics fluctuate unsteadily, are expanded and compressed on the time axis in the same manner as for steady sections in which the acoustic characteristics are steadily maintained, the listener could perceive sound that creates an unnatural impression and that deviates from the sound before its expansion or compression. An audio processing method in accordance with some embodiments including; extracting feature quantities from a first audio signal for each of a plurality of periods, and generating a second audio signal by time axis expanding/compressing on a time axis either a section of the first audio signal in which the feature quantity is steadily maintained for a period time, or a section of the first audio signal in which a fluctuation of the feature quantity is repeated and excluding from the time axis expanding/compressing a section in which a fluctuation of the feature quantity is not similar to that of other sections.

An audio processing method in accordance with some embodiments including: extracting a feature quantity of a first audio signal for each of a plurality of first periods, calculating a similarity index of the feature quantity between each of the plurality of first periods, executing a time correspondence process for making the plurality of first periods correspond to a plurality of second periods within a target period after expansion/compression of the first audio signal, in accordance with the similarity index and a transition cost for transitioning between each of the plurality of first periods, and generating a second audio signal over the target period from a result of making the plurality of first periods correspond to each of the plurality of second periods.

An audio processing device in accordance with some embodiments including: an electronic controller having a feature extraction unit and a signal generating unit. The feature extraction unit is configured to extract a feature quantity of a first audio signal for each of a plurality of periods. The signal generating unit is configured to generate a second audio signal by time axis expanding/compressing on a time axis either a section of the first audio signal in which the feature quantity is steadily maintained for a period time, or a section of the first audio signal in which a fluctuation of the feature quantity is repeated and excluding from the time axis expanding/compressing a section in which a fluctuation of the feature quantity is not similar to that of other sections of the first audio signal.

An audio processing device in accordance with some embodiments including: an electronic controller having a feature extraction unit, an index calculation unit, an analysis processing unit and a signal generating unit. The feature extraction unit is configured to extract a feature quantity of a first audio signal for each of a plurality of first periods. The index calculation unit is configured to calculate a similarity index of the feature quantity between each of the plurality of first periods. The analysis processing unit is configured to make the plurality of first periods correspond to a plurality of second periods within a target period after expansion/compression of the first audio signal in accordance with the similarity index and a transition cost for transitioning between each of the plurality of first periods. The signal generating unit is configured to generate a second audio signal over the target period from a result obtained upon the analysis processing unit making the plurality of first periods correspond to the plurality of second periods.

DETAILED DESCRIPTION OF THE EMBODIMENTS

First Embodiment

Selected embodiments will now be explained with reference to the drawings. It will be apparent to those skilled in the position detection field and the substrate field from this disclosure that the following descriptions of the embodiments are provided for illustration only and not for the purpose of limiting the invention as defined by the appended claims and their equivalents.

Figure 1:
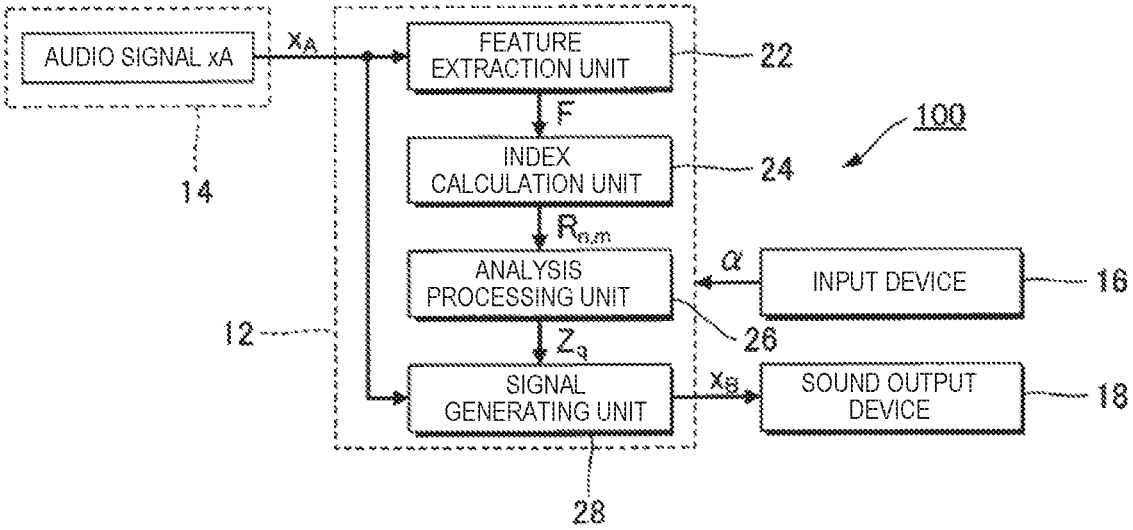
FIG. 1 is a block diagram of an audio processing device according to a first embodiment.

FIG. 1 is a block diagram of an audio processing device 100 according to the first embodiment. As illustrated in FIG. 1, the audio processing device 100 according to the first embodiment is realized by a computer system comprising an electronic controller 12, a computer storage device 14, an input device 16, and a sound output device 18. For example, a portable information processing device such as a mobile phone or a smartphone, or a portable or stationary information processing device such a personal computer, can be used as the audio processing device 100.

A program that is executed by the electronic controller 12 and various data that are used by the electronic controller 12 are stored in the storage device 14. The storage device 14 is any computer storage device or any computer readable medium with the sole exception of a transitory, propagating signal. The storage device 14 can include nonvolatile memory and volatile memory. For example, the storage device 14 can includes a ROM (Read Only Memory) device, a RAM (Random Access Memory) device, a hard disk, a flash drive, etc. Thus, any known storage medium, such as a magnetic storage medium or a semiconductor storage medium, or a combination of a plurality of types of storage media can be freely employed as the storage device 14. An audio signal $x_A$ (example of a first audio signal) that represents various sounds such as musical sounds, voice, and the like are stored in the storage device 14 of the first embodiment. It is also possible, for example, to supply an audio signal $x_A$ to the audio processing device 100 from a reproduction device that reproduces the audio signal $x_A$ that is stored in a storage medium, such as an optical disc.

Figure 2:
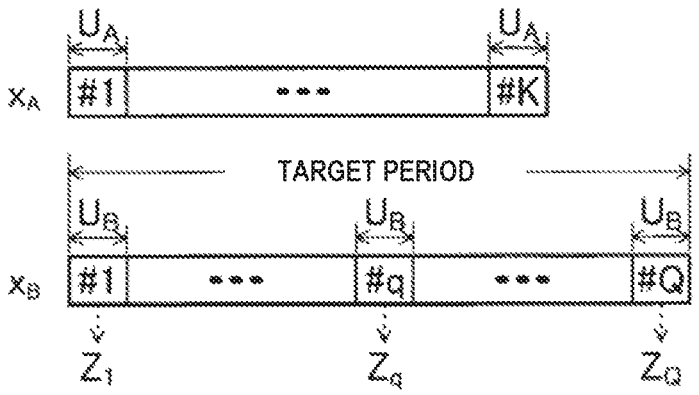
FIG. 2 is an explanatory view of the time axis expansion/compression of an audio signal.

The electronic controller 12 is formed of one or more semiconductor chips that are mounted on a printed circuit board. The term "electronic controller" as used herein refers to hardware that executes software programs. The electronic controller 12 includes a processing circuit such as a CPU (Central Processing Unit) having at least one processor that comprehensively controls each element of the audio processing device 100. As is illustrated in FIG. 2, the electronic controller 12 of the first embodiment generates an audio signal $x_B$ (example of a second audio signal) obtained by time axis expanding/compressing the audio signal $x_A$ on a time axis. The sound output device 18 of FIG. 1 (for example, a speaker or headphones) outputs sound corresponding to the audio signal $x_B$ that is generated by the electronic controller 12. Illustrations of a D/A converter that converts the audio signal $x_B$ from digital to analog and of an amplifier that amplifies the audio signal $x_B$ have been omitted for the sake of brevity.

The input device 16 is a user operable input device that receives instructions from a user. For example, a plurality of operators or a touch panel can be suitably used as the input device 16. By appropriately operating the input device 16, the user can arbitrarily set the expansion/compression ratio $\alpha$. The expansion/compression ratio $\alpha$ is a time ratio of the audio signal $x_B$ relative to the audio signal $x_A$. That is, as illustrated in FIG. 2, the electronic controller 12 generates an audio signal $x_B$ over a period having a time length that is $\alpha$ times the audio signal $x_A$ (hereinafter referred to as "target period"). Specifically, when the expansion/compression ratio $\alpha$ is less than 1, an audio signal $x_B$ obtained by compression of the audio signal $x_A$ on a time axis is generated, and when the expansion/compression ratio $\alpha$ exceeds 1, an audio signal $x_B$ obtained by expanding the audio signal $x_A$ on a time axis is generated.

As illustrated in FIG. 1, the electronic controller 12 of the first embodiment realizes a plurality of functions (a feature extraction unit 22, an index calculation unit 24, an analysis processing unit 26, and a signal generating unit 28) for generating an audio signal $x_B$ by time axis expanding/compressing the audio signal $x_A$, by executing a program stored in the storage device 14. Moreover, a configuration in which the functions of the electronic controller 12 are distributed to a plurality of devices or a configuration in which all or part of the functions of the electronic controller 12 are realized by a dedicated electronic circuit may also be employed.

The feature extraction unit 22 extracts a feature quantity F relating to the acoustic characteristics of the audio signal $x_A$. As illustrated in FIG. 2, the feature extraction unit 22 of the first embodiment extracts a feature quantity F of the audio signal $x_A$ for each of a plurality (K) of periods $U_A$ obtained by dividing the audio signal $x_A$ on the time axis. Each period $U_A$ (example of a first period) is a section (frame) having a prescribed time length. Successive periods $U_A$ can overlap. The type of feature quantity F that is extracted by the feature extraction unit 22 is arbitrary, but it is preferably a type of feature quantity F with which it is possible to appropriately express an auditory characteristic of the sound presented by the audio signal $x_A$. For example, the amplitude spectrum of the audio signal $x_A$, or the temporal change of the amplitude spectrum (for example, temporal differentiation) are suitable as the feature quantity F. It is also possible to extract the pitch, the power, the spectral envelope, etc., from the audio signal $x_A$ as the feature quantity F. In addition, for example, if the audio signal $x_A$ represents the sound of a percussion instrument being played, then a feature quantity F such as power, attenuation characteristic (attenuation factor from the point of sound generation), or MFCC (Mel-Frequency Cepstrum Coefficients) is suitable.

Figure 3:
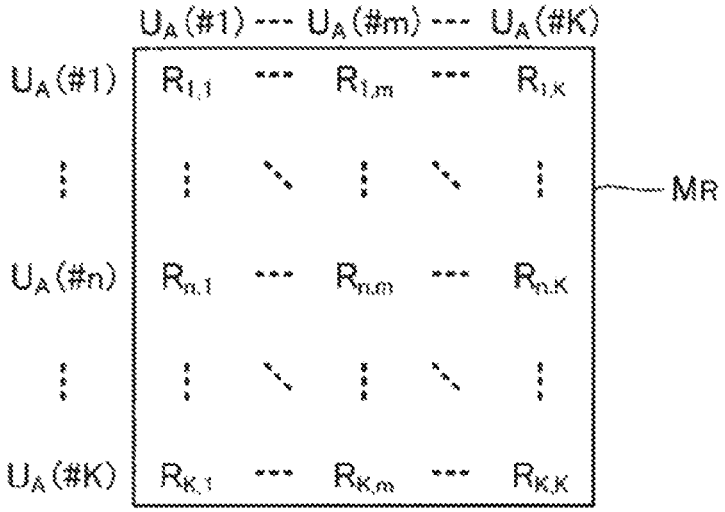
FIG. 3 is an explanatory view of a similarity matrix.

The index calculation unit 24 calculates similarity indices $R_{n,m}$ of the feature quantities F between each of the K periods $U_A$ of the audio signal $x_A$. The index calculation unit 24 of the first embodiment generates a similarity matrix MR such as that illustrated in FIG. 3. A similarity matrix MR is a square matrix of K rows×K columns, having similar indices $R_{1,1}$ to $R_{K,K}$ as elements. With regard to the similarity matrix MR, the similarity index $R_{n,m}$ positioned in the nth row and mth column (n, m=1 to K) is an indicator of similarity between the feature quantity F of the nth period $U_A$ and the feature quantity F of the mth period $U_A$, from among the K periods $U_A$. In the first embodiment, the distance between two feature quantities F is exemplified as the similarity index $R_{n,m}$. A typical example of a distance that can be used as the similarity index $R_{n,m}$ is the Euclidean distance. However, various distance standards, such as the Itakura-Saito distance or I-divergence, can also be used as the similarity index $R_{n,m}$. As can be understood from the description above, in the first embodiment, the similarity index $R_{n,m}$ takes on smaller numerical values as the two feature quantities F become more similar to each other.

The analysis processing unit 26 makes one of the K periods $U_A$ of the audio signal $X_A$ correspond to each of a plurality (Q) periods $U_B$ within a target period of FIG. 2 over a time length that is a times the audio signal $x_A$. That is, a path search process that analyzes the optimum correspondence between each period $U_A$ of the audio signal $x_A$ and each period $U_B$ of the audio signal $x_B$ is executed. Specifically, the analysis processing unit 26 calculates Q indices $Z_1$ to $Z_Q$, which correspond to different periods $U_B$ within the target period. One arbitrary index $Z_q$ is set to the number (1 to K) of the period $U_A$ that corresponds to the qth (l=1 to Q) period $U_B$ of the target period, from among the K periods $U_A$ of the audio signal $x_A$. Each period $U_B$ (example of a second period) is a section having a prescribed time length. Successive periods $U_B$ can overlap.

The signal generating unit 28 generates an audio signal $x_B$ over the target period from the result (indices $Z_1$ to $Z_Q$) of the analysis processing unit 26 making the period $U_A$ correspond to each of the Q periods $U_B$. Briefly, the audio signal $x_B$ over the target period is generated by arranging the period $U_A$ specified by one arbitrary index $Z_q$ from among the K periods $U_A$ of the audio signal $x_A$ over the Q periods $U_B$.

Specifically, the signal generating unit 28 generates the complex spectra $X_{B1}$ to $X_{BQ}$ of the audio signal $x_B$ for each period $U_B$ from the complex spectra $X_{A1}$ to $X_{AK}$ of each period $U_A$ of the audio signal $x_A$, converts each of the plurality of complex spectra $X_{B1}$ to $X_{BQ}$ into the time domain by an inverse Fourier transform and then interconnects them, thereby generating an audio signal $x_B$. The complex spectrum $X_{Bq}$ of the audio signal $x_B$ in one arbitrary period $U_B$, for example, can be expressed by the following formula (1).

Formula 1

$$X_{Bq}=|X_{AZq}|\angle(\arg X_{Bq-1}+\Delta\phi_q)$$

$$X_{B1}=X_{AZ1}$$

$$\Delta\phi_q=\arg(X_{AZq})-\arg(X_{AZq-1}) \quad (1)$$

That is, the complex spectrum $X_{Bq}$ of the qth period $U_B$ of the audio signal $x_B$ is made up of the amplitude spectrum $|X_{AZq}|$ of the period $U_A$ of the audio signal $x_A$ specified by the index $Z_q$ and the phase spectrum obtained by adding the phase difference $\Delta\varphi_q$ to the phase angle arg $X_{Bq-1}$ of the immediately preceding (q−1)th period $U_B$. The phase difference $\Delta\varphi_q$ is the difference between the phase angle arg ($X_{AZq}$) for the period $U_A$ of the audio signal $x_A$ specified by the index $Z_q$ and the phase angle arg ($X_{AZq-1}$) of the immediately preceding period $U_A$. That is, the signal generating unit 28 of the first embodiment generates the complex spectrum $X_{Bq}$ of the audio signal $x_B$ by using a phase vocoder technique. However, the method for generating an audio signal $x_B$ corresponding to the processing result by the analysis processing unit 26 is not limited to the example described above. For example, it is also possible to generate an audio signal $x_B$ by using audio processing technique such as PSOLA (Pitch Synchronous Overlap and Add), or the like.

Figure 4:
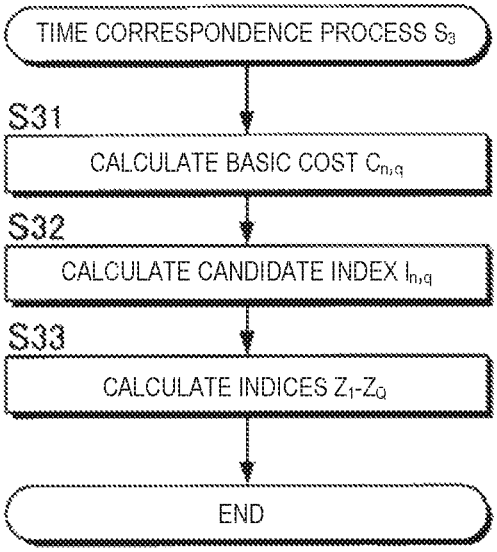
FIG. 4 is a flowchart of a time correspondence process executed by the electronic controller.

The specific operation of the analysis processing unit 26 will now be described. FIG. 4 is a flowchart of a process for the analysis processing unit 26 to make a period $U_A$ correspond to each of Q periods $U_B$ (hereinafter referred to as "time correspondence process") S3.

Figure 5:
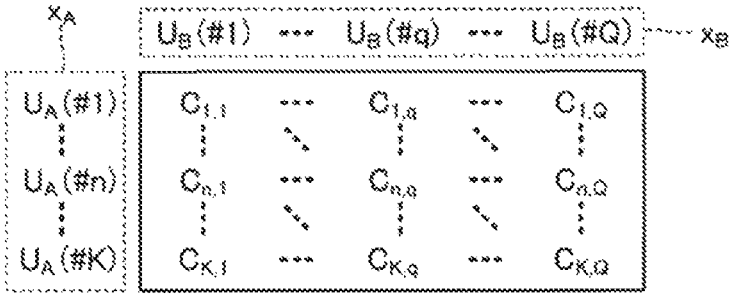
FIG. 5 is an explanatory view of a basic cost matrix having basic costs as elements.

The analysis processing unit 26 calculates a basic cost $C_{n,q}$ for each period $U_A$ Of the audio signal $x_A$ for each of the Q periods $U_B$ within the target period (S31). The basic cost $C_{n,q}$ is calculated for each combination of each of the K periods $U_A$ and each of the Q periods $U_B$. As illustrated in FIG. 5, a matrix with K rows and Q columns having the basic costs $C_{n,q}$($C_{1,1}$ to $C_{K,Q}$) as elements is generated. One arbitrary basic cost $C_{n,q}$ is the minimum cost when reproducing the nth period $U_A$ of the audio signal $x_A$ in the qth period $U_B$ of the audio signal $x_B$. Specifically, as is expressed by the following recurrence formula (2), the analysis processing unit 26 calculates the minimum value (min) of K allocation costs $\Psi_{q-1,n,1}$ to $\Psi_{q-1,n,K}$, which correspond to different periods $U_A$, calculated with respect to the immediately preceding ((q−1)th) period $U_B$, as the basic cost $C_{n,q}$.

Formula 2

$$C_{n,q}=\min_m \{C_{m,q-1}+R_{n-1,m}+T_{n,m}\} \quad (2)$$
$$=\min_m \Psi_{q-1,n,m}$$

As can be understood from formula (2), the allocation cost $\Psi_{q-1,n,m}$ that is used for calculating the basic cost $C_{n,q}$ that corresponds to the qth period $U_B$ and the nth period $U_A$ is the sum of the basic cost $C_{m,q-1}$ of the immediately preceding period $U_B$, the similarity index $R_{n-1,m}$, and the transition cost $T_{n,m}$. The similarity index $R_{n-1,m}$ is the distance of the feature quantity F between the (n−1)th period $U_A$ of the audio signal $x_A$ and an arbitrary (mth) period $U_A$ of the audio signal $x_A$. Therefore, the allocation cost $\Psi_{q-1,n,m}$ becomes a smaller numerical value and becomes more likely to be selected as the basic cost $C_{n,q}$, as the feature quantities F become more similar between the (n−1)th period $U_A$ and the mth period $U_A$ of the audio signal $x_A$.

Figure 6:
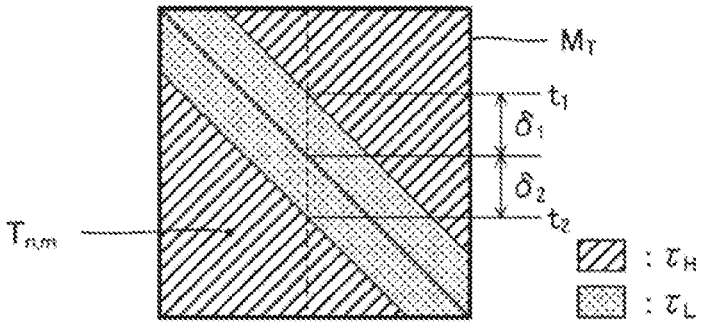
FIG. 6 is an explanatory view of a transition matrix.

The transition cost $T_{n,m}$ is the cost when transitioning from the nth period $U_A$ to an arbitrary (mth) period $U_A$ of the audio signal $x_A$. Specifically, as shown in FIG. 6, a transition matrix MT of K rows×K columns having transition costs as elements is stored in the storage device 14, and the analysis processing unit 26 specifies the transition cost $T_{n,m}$ that corresponds to the combination of arbitrary periods $U_A$ from the transition matrix MT.

If there is a jump in the audio signal $x_B$ to a period $U_A$ (mth) that is separated from the nth period $U_A$ of the audio signal $x_A$ on the time axis, then the reproduced audio signal $x_B$ creates an unnatural sound. Therefore, the analysis processing unit 26 sets the transition cost $T_{n,m}$ for a transition from the nth period $U_A$ to a period $U_A$ that is ahead of time $t_1$, which is earlier than the nth period $U_A$ by a threshold $\delta_1$ ($n-\delta_1>m$), to a numerical value $\tau_H$. Similarly, the analysis processing unit 26 sets the transition cost $T_{n,m}$ for a transition from the nth period $U_A$ to a period $U_A$ that is after time $t_2$, which is later than the nth period $U_A$ by a threshold $\delta_2$ ($n+\delta_2<m$), to a numerical value $\tau_H$. The numerical value $\tau_H$ is a sufficiently lame numerical value (for example, to $\tau_H=\infty$). Therefore, the allocation cost $\Psi_{q-1,n,m}$ that corresponds to a transition from the nth period $U_A$ to a period ahead of time $t_1$, or, the allocation cost $\Psi_{q-1,n,m}$ that corresponds to a transition from the nth period to a period after time $t_2$, is not selected as the basic cost $C_{n,q}$. On the other hand, the transition cost $T_{n,m}$ for a transition from the nth period $U_A$ to a period between time $t_1$, which is earlier than the nth period $U_A$ by a threshold $\delta_1$ and time $t_2$, which is later than the nth period $U_A$ by a threshold $\delta_2$ ($n-\delta_1\leq m\leq n+\delta_2$), is set to a numerical value $\tau_L$. The numerical value $\tau_L$ is a numerical value that is sufficiently less than the numerical value $\tau_H$ (for example, zero). That is, a transition within a prescribed range with respect to the nth period $U_A$ is permitted. The setting of the transition cost $T_{n,m}$ illustrated above can be expressed by the following formula (3).

Formula 3

$$T_{n,m} = \begin{cases} \tau_L & \text{if } n-\delta_1 \le m \le n+\delta_2 \\ \tau_H & \text{if } n+\delta_2 < m \text{ or } n-\delta_1 > m \end{cases} \quad (3)$$

In addition to the calculation of the basic cost $C_{n,q}$ illustrated above, the analysis processing unit 26 of the first embodiment calculates a candidate index $I_{n,q}$ by using the following recurrence formula (4) (S32).

Formula 4

$$\begin{aligned} I_{n,q} &= \arg\min_m \{C_{m,q-1} + R_{n-1,m} + T_{n,m}\} \\ &= \arg\min_m \Psi_{q-1,n,m} \end{aligned} \quad (4)$$

That is, the analysis processing unit 26 calculates a variable in that minimizes the allocation cost $\Psi_{q-1,n,m}$ as a candidate index $I_{n,q}$ of the qth period $U_B$. Specifically, a variable m that corresponds to the minimum value of K allocation costs $\Psi_{q-1,n,1}$ to $\Psi_{q-1,n,K}$, calculated for the immediately preceding ((q−1)-th) period $U_B$ and corresponding to different periods $U_A$, is adopted as the candidate index $I_{n,q}$ of the period $U_B$.

Then, as is expressed by the following formula (5), the analysis processing unit 26 sets an index $Z_Q$ at the end (qth) of the target period to the number K of the period $U_A$ that is positioned at the end of the audio signal $x_A$, and, by tracking back the candidate index $I_{n,q}$ (backtrack) toward the front of the time axis therefrom, sets an index $Z_q$ for each of the Q periods $U_B$ within the target period (S33).

Formula 5

$$Z_q = \begin{cases} N & q = Q \\ I_{Z_{q+1},q+1} & q < Q \end{cases} \quad (5)$$

Figure 7:
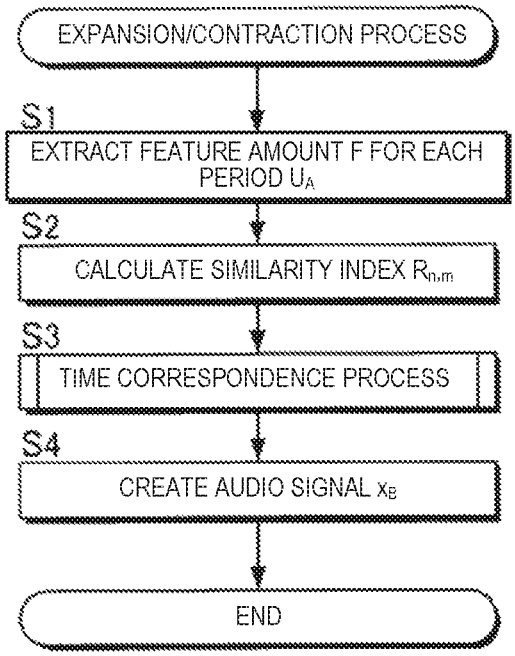
FIG. 7 is a flowchart of a time axis expansion/compression process executed by the electronic controller.

FIG. 7 is a flowchart of a process for the audio processing device 100 of the first embodiment to expand/compress the audio signal $x_A$ (hereinafter referred to as "time axis expansion/compression process"). For example, the time axis expansion/compression process of FIG. 7 is started when the user gives the input device 16 an operation to instruct a time axis expansion/compression of the audio signal $x_A$.

When the time axis expansion/compression process is started, the feature extraction unit 22 extracts a feature quantity F for each period $U_A$ of the audio signal $x_A$ stored in the storage device 14 (S1). The index calculation unit 24 calculates similarity indices $R_{n,m}$ of the feature quantities F extracted by the feature extraction unit 22 between each of the K periods $U_A$ of the audio signal $x_A$ (S2).

The analysis processing unit 26 makes the period $U_A$ correspond to each of the Q periods $U_B$ within the target period by using the time correspondence process S3 (S31-S33) described above with reference to FIG. 4. That is, the analysis processing unit 26 sets an index $Z_q$ for each of the Q periods $U_B$. The signal generating unit 28 generates an audio signal $x_B$ over the target period from the result (indices $Z_1$ to $Z_Q$) of the time correspondence process S3 (S4).

Figure 8:
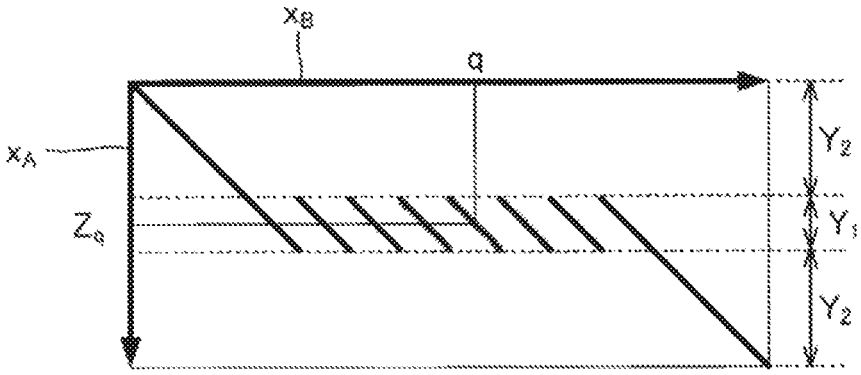
FIG. 8 is an explanatory view of a relationship between audio signals for the period before and after time axis expansion/compression.

FIG. 8 is a schematic view of the correspondence relationship between the audio signal $x_A$ (vertical axis) and the audio signal $x_B$ (horizontal axis). As described above, the analysis processing unit 26 makes one of the K periods $U_A$ Of the audio signal $x_A$ correspond to each of the Q periods $U_B$ within a target period, in accordance with the allocation cost $\Psi_{q-1,n,m}$. Specifically, the analysis processing unit 26 makes one of the K periods $U_A$ correspond to each period $U_B$ such that the allocation cost $\Psi_{q-1,n,m}$ is decreased (more preferably, minimized). The allocation cost $\Psi_{q-1,n,m}$ of the first embodiment is calculated according to the similarity index $R_{n-1,m}$ of the feature quantity F between the ((n−1)th) period immediately before the nth period and the mth period $U_A$. Therefore, as is illustrated in FIG. 8, a section $Y_1$ that includes a steady section of the audio signal $x_A$ in which the feature quantity F is steadily maintained on the time axis, and a fluctuation section in which a fluctuation of the feature quantity F is repeated (for example, one cycle of vibrato), is expanded/compressed on the time axis (that is, repeated multiple times), and a transient section $Y_2$ in which a fluctuation of the feature quantity F does not resemble that of other sections (for example, a section in which the feature quantity F fluctuates unsteadily, such as with a glissando) is excluded as an object of time axis expansion/compression. Thus, for example, compared with a configuration in which both a steady section in which the feature quantity F is steadily maintained and a transient section in which the feature quantity F fluctuates unsteadily are expanded/compressed in the same manner, it is possible to expand/compress the audio signal $x_A$ while maintaining auditory naturalness.

In addition, because the allocation cost $\Psi_{q-1,n,m}$ of the first embodiment is calculated according to the transition cost $T_{n,m}$ from the nth period $U_A$ to the mth period $U_A$, a transition between two periods $U_A$ that widely diverge from each other on the time axis is restricted. From the above point of view as well, it is possible to realize the above-described effect of being able to expand/compress the audio signal $x_A$ while maintaining auditory naturalness. In the first embodiment in particular, the transition cost $T_{n,m}$ is set to the numerical value $\tau_L$ (example of a first value) when the time difference between the nth period $U_A$ and the mth period $U_A$ is below a threshold value ($n-\delta_1 \le m \le n+\delta_2$), and the transition cost $T_{n,m}$ is set to the numerical value $\tau_H$ (example of a second value) when the time difference exceeds the threshold value ($n-\delta_1 > m$, $n+\delta_2 < M$). That is, the transition between two periods $U_A$ of the audio signal $x_A$ is constrained within a prescribed range. Therefore, it is to be noted that the above-described effect, that it is possible to expand/compress audio signals while maintaining auditory naturalness, is remarkable.

Second Embodiment

The second embodiment of the present invention will now be described. In each of the embodiments illustrated below, elements that have the same actions or functions as in the first embodiment have been the same reference symbols as those used to describe the first embodiment, and detailed descriptions thereof have been appropriately omitted.

Figure 9:
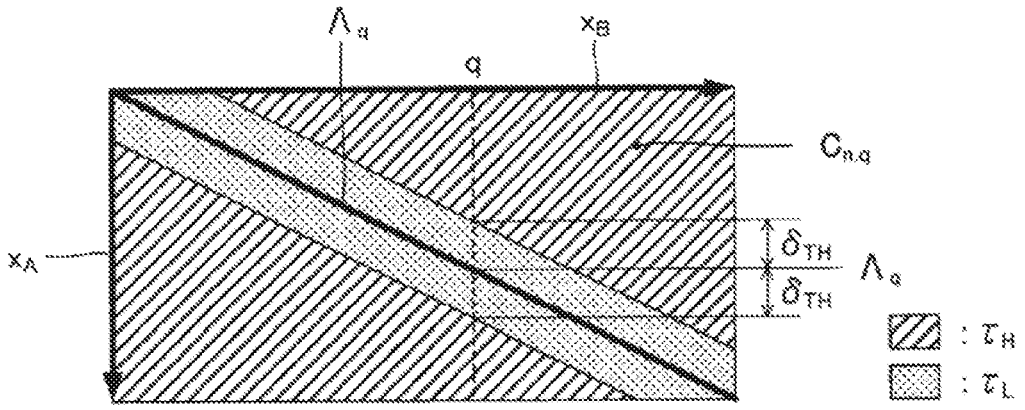
FIG. 9 is an explanatory view of a relationship between audio signals for a basic cost in a second embodiment.

In the second embodiment, as well as in the third embodiment, which is described below, a provisional relationship (hereinafter referred to as "provisional relationship") is set between each of the periods $U_A$ of the audio signal $x_A$ and each of the periods $U_B$ of the audio signal $x_B$, and an index $Z_q$ is set for each of the periods $U_B$ within the target period so as to not excessively deviate from the provisional relationship. As illustrated in FIG. 9, the provisional relationship is defined by a provisional index $A_q$, which indicates the relationship between each period $U_A$ and each period $U_B$.

For example, in the second embodiment, the provisional index $A_q$ is defined b the following formula (6), in order to express a provisional relationship in which the first period $U_A$ to the Kth period $U_A$ of the audio signal $x_A$ uniformly correspond to the time series of Q periods $U_B$.

Formula 6

$$\Lambda_q = \frac{q}{\alpha} \tag{6}$$

As can be understood from formula (6), under the provisional relationship, the Kth period $U_A$ of the audio signal $x_A$ corresponds to the qth period $U_B$ ($q=Q=\alpha K$)($A_Q=K$). As can be understood from formula (6), it can also be said that the provisional relationship of the second embodiment is a correspondence relationship between each period $U_A$ and each period $U_B$, when the audio signal $x_A$ is uniformly expanded/compressed over all the sections to generate the audio signal $x_B$.

In the second embodiment, the basic cost $C_{n,q}$ is set such that the relationship between each period $U_A$ and each period $U_B$ specified by the index $Z_q$ does not deviate widely from the provisional relationship of formula (6). Specifically, the analysis processing unit 26 sets the basic cost $C_{n,q}$ by means of the following formula (7).

Formula 7

$$C_{n,q}=\tau_H \text{ if } |A_q-n|>\delta_{TH} \tag{7}$$

As can be understood from formula (7), of K basic costs $C_{t,q}$ to $C_{K,q}$ that are calculated for the qth period $U_B$, a basic cost $C_{n,q}$ that is outside of a prescribed range (hereinafter referred to as "allowable range") that corresponds to the period $U_B$ on the basis of the provisional relationship of formula (6), is set to the numerical value $\tau_H$. As is illustrated in FIG. 9, the allowable range is a range with a prescribed width ($2\times\delta TH$) centered around the period $U_A$ indicated by the provisional index $A_q$. The numerical value $\tau_H$ of formula (7) is set to a sufficiently large numerical value (for example, $\tau_H=\infty$). Thus, the relationship between each period $U_A$ and each period $U_B$ is limited to within the allowable range with respect to the provisional relationship.

As can be understood from the description above, in the second embodiment, the basic cost $C_{n,q}$ is set such that a period $U_A$ within an allowable range defined by the provisional relationship of formula (6) corresponds to the qth period $U_B$. Thus, it is possible to generate the audio signal $x_B$ within a range that does not deviate widely from the provisional relationship between each period $U_A$ and each period $U_B$.

Third Embodiment

Figure 10:
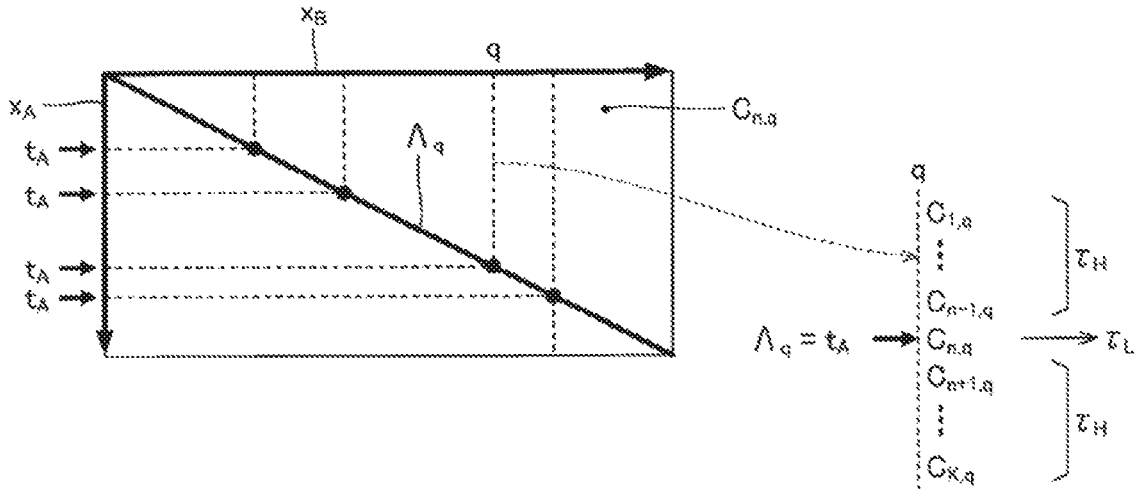
FIG. 10 is an explanatory view of a relationship between audio signals for a basic cost in a third embodiment.

FIG. 10 is an explanatory view of the basic cost $C_{n,q}$ in the third embodiment. If the ratio of the interval between the points in time when various sounds start in the audio signal $x_A$ (hereinafter referred to as "sound generation points") changes without being maintained in the audio signal $x_B$, the reproduced audio signal $x_B$ will sound unnatural, wherein the rhythm of generated sound fluctuates irregularly. Therefore, in the third embodiment, as illustrated in FIG. 10, the basic cost $C_{n,q}$ is set such that a period $U_A$ of the audio signal $x_A$ corresponding to a sound generation point $t_A$, and a period $U_B$ corresponding to said sound generation point $t_A$ under a provisional relationship, correspond to each other. Any known technique can be employed for detecting the sound generation point $t_A$ of the audio signal $x_A$.

Specifically, the analysis processing unit 26 sets the basic cost $C_{n,q}$ as in formula (8) below with respect to a period $U_B$ corresponding to a sound generation point $t_A$ of the audio signal $X_A$ under the provisional relationship (that is, the period $U_B$ in which $A_q=t_A$).

Formula 8

$$C_{n,q} = \begin{cases} \tau_L & n = \Lambda_q \\ \tau_H & n \neq \Lambda_q \end{cases} \tag{8}$$

As can be understood from formula (8) and formula (10), of K basic costs $C_{1,q}$ to $C_{K,q}$ that arc calculated for the qth period $U_B$ corresponding to the sound generation point $t_A$ under the provisional relationship, a basic cost $C_{n,q}$ of one period $U_A$ in which the sound generation point $t_A$ exists ($n=A_q$) is set to the numerical value $\tau_L$. On the other hand, the basic cost $C_{n,q}$ of a period $U_A$ in which the sound generation point $t_A$ does not exist ($n\neq A_q$) is set to a numerical value $\tau_H$, which sufficiently exceeds the numerical value $\tau_L$. The numerical value $\tau_L$ is, for example, set to zero ($\tau_L=0$), and the numerical value $\tau_H$ is, for example, set to infinity ($\tau_H=\infty$).

According to the configuration above, with respect to a period $U_B$ corresponding to the sound generation point $t_A$ wider the provisional relationship, only the number n of the period $U_A$, which corresponds to said sound generation point $t_A$ from among K periods $U_A$, is employed as the index $Z_q$. Therefore, the time ratio between each sound generation point $t_A$ in the sound generation point $t_A$ is also equally maintained in the audio signal $x_B$. That is, according to the second embodiment, there is the benefit that it is possible to generate an audibly natural audio signal $x_B$, in which the rhythm of the generated sound remains equal to that of audio signal $x_A$. It is also possible to apply the configuration of the second embodiment to the third embodiment.

Modifications

Each of the embodiments exemplified above may be variously modified. Specific modified embodiments are illustrated below. Two or more embodiments arbitrarily selected from the following examples can be appropriately combined as long as they are not mutually contradictory.

(1) In each of the above-described embodiments, the analysis processing unit 26 sets the transition cost $T_{n,m}$ with reference to the transition matrix MT illustrated in FIG. 6; however, it is also possible to store a vector that corresponds to one column of the transition matrix MT (hereinafter referred to as "transition vector") in the storage device 14. The analysis processing unit 26 specifies the transition cost $T_{n,m}$ corresponding to the combination of two periods $U_A$ of the transition target front the transition vector. Thus, since it is not necessary to store a transition matrix MT having K rows×K columns, in accordance with the configuration described above, the storage capacity required for the storage device 14 can be reduced.

(2) In each of the above-described embodiments, all of the sections of the audio signal $x_A$ are expanded/compressed with a common expansion/compression ratio $\alpha$; however, it is also possible to change the expansion/compression ratio $\alpha$ in real-time at an arbitrary point in time of the audio signal $x_B$. For example, a configuration is assumed in which the target period is divided into a plurality of unit sections on a time axis, and the time axis expansion/compression process of FIG. 7 is sequentially executed for each unit section. For example, the expansion/compression ratio $\alpha$ is updated for each unit section in accordance with an operation from the input device 16. It is also possible to restrict the period $U_B$ at the end of one arbitrary unit section and the period $U_B$ at the beginning of the immediately following unit section to a combination of corresponding periods $U_A$ therebefore and thereafter of the audio signal $x_A$.

(3) In each of the above-described embodiments, a linear relationship is exemplified (formula (6)) as the provisional relationship between each period $U_A$ of the audio signal $x_A$ and each period $U_B$ of the audio signal $x_B$; however, the provisional relationship is not limited to the example described above. For example, it is also possible to employ a curvilinear relationship (for example, $A_q=\beta\times q^2$) as the provisional relationship between each period $U_A$ and each period $U_B$ (where $\beta$ is a prescribed positive number).

(4) It is also possible to realize the audio processing device 100 with a server device that communicates with terminal devices (for example, mobile phones and smartphones) via a communication network such as a mobile communication network or the Internet. Specifically, the audio processing device 100 generates an audio signal $x_B$ by means of the time axis expansion/compression process illustrated in FIG. 7 that is applied to an audio signal $x_A$ received from a terminal device and transmits the audio signal $x_B$ after time axis expansion/compression to the terminal device.

(5) The audio processing device 100 illustrated in each of the above-described embodiments is realized cooperation between the electronic controller 12 and a program, as is illustrated in each of the above-described embodiments. A program according to a preferred aspect of the present invention causes a computer to function as a feature extraction unit 22 for extracting a feature quantity F of an audio signal $x_A$ for each of a plurality of periods $U_A$; as an index calculation unit 24 for calculating a index $R_{n,m}$ of the feature quantity F between each of the periods $U_A$; as an analysis processing unit 26 for making one of the plurality of periods $U_A$ correspond to each of a plurality of periods $U_B$ within a target period such that an allocation cost $\Psi_{q-1,n,m}$ corresponding to the similarity index $R_{n,m}$ between each period $U_A$ and a transition cost $T_{n,m}$ for transitioning between each period $U_A$ is minimized; and as a signal generating unit 28 for generating an audio signal $x_B$ over the target period from the result obtained when the analysis processing unit 26 causes the period $U_A$ to correspond to each of the plurality of periods $U_B$.

The program exemplified above can be stored on a computer-readable storage medium and installed in a computer. The storage medium is, for example, a non-transitory (non-transitory) storage medium, a good example of which is an optical storage medium, such as a CD-ROM (optical disc), but may include well-known arbitrary storage medium formats, such as semiconductor storage media and magnetic storage media. Non-transitory storage media include any storage medium that excludes transitory propagating signals and does not exclude volatile storage media. Furthermore, it is also possible to deliver the program to a computer in the form of distribution via a communication network.

(6) For example, the following configurations may be understood from the embodiments exemplified above.

Aspect 1

An audio processing method according to a preferred aspect (Aspect 1) of the present invention comprises extracting a feature quantity of a first audio signal for each of a plurality of periods; and generating a second audio signal by time axis expanding/compressing either a section of the first audio signal in which the feature quantity is steadily maintained for a period time, or a section of the first audio signal in which a fluctuation of the feature quantity is repeated and excluding from the time axis expanding/compressing a section in which a fluctuation of the feature quantity is not similar to that of other sections. Thus, for example, compared with a configuration in which the first audio signal is uniformly expanded/compressed over all the sections including both a steady section in which the feature quantity is steadily maintained and a transient section in which the feature quantity fluctuates unsteadily, it is possible to expand compress the audio signal while maintaining auditory naturalness.

Aspect 2

An audio processing method according to a preferred aspect (Aspect 2) of the present invention comprises extracting a feature quantity of a first audio signal for each of a plurality of first periods; calculating a similarity index of the feature quantity between each of the plurality of first periods; executing a time correspondence process for making one of the plurality of first periods correspond to a plurality of second periods within a target period after expansion/compression of the first audio signal in accordance with the similarity index and a transition cost for transitioning between each of the plurality of first periods; and generating a second audio signal over the target period from a result obtained making the plurality of first periods correspond to the plurality of second periods. In the aspect described above, a first period is made to correspond to each second period within the target period such that the allocation cost corresponding to the similarity index between each first period is minimized. That is, a section of the first audio signal in which the feature quantity is steadily maintained on the time axis and or a section in which a fluctuation of the feature quantity is repeated (for example, one cycle of vibrato) is expanded/compressed on the time axis, and sections in which a fluctuation of the feature quantity does not resemble that of other sections (for example, a transient section in which the feature quantity fluctuates unsteadily, such as a glissando) are excluded as an object of expansion/compression. Thus, for example, compared to a configuration in which the first audio signal is uniformly expanded/compressed over all the sections including both a steady section in which the feature quantity is steadily maintained and a transient section in which the feature quantity fluctuates unsteadily, it is possible to expand/compress the audio signal while maintaining auditory naturalness. In addition, a first period is made to correspond to each second period within the target period, in in correspondence with the transition cost for transitioning between each of the first periods. Therefore, transitions between first periods that are widely divergent on the time axis is restricted. From the above point of view as well, it is possible to realize the above-described effect of being able to expand/compress the audio signal while maintaining auditory naturalness.

Aspect 3

In a preferred example (Aspect 3) of Aspect 2, in the time correspondence process, one of the plurality of first periods is made to correspond to each of the plurality of second periods within the target period after expansion/compression of the first audio signal, such that an allocation cost, corresponding to the similarity index and to the transition cost for transitioning between each of the plurality of first periods is reduced. In the aspect described above, a first period is made to correspond to each second period within the target period such that the allocation cost is reduced. Therefore, transitions between first periods that are widely divergent on the time axis is restricted.

Aspect 4

In a preferred example (Aspect 4) of Aspect 3, in the time correspondence process, one of the plurality of first periods is made to correspond to each of the plurality of second periods within the target period after expansion/compression of the first audio signal, such that the allocation cost is minimized. In the aspect described above, in the aspect described above, a first period is made to correspond to each second period within the target period such that the allocation cost is minimized. Therefore, the effect that transitions between first periods that are excessively divergent on the time axis is restricted is remarkable.

Aspect 5

In a preferred example (Aspect 5) of any one of Aspects 2 to 4, in the time correspondence process, the transition cost between two first periods from among the plurality of first periods is set to a first value when a time difference between the two first periods is below a threshold value and is set to a second value that is greater the first value when the time difference exceeds the threshold value. In the aspect described above, because the transition cost is set to a first value when the time difference between two first periods is below a threshold value, and the transition cost is set to a second Value that is greater the first value when the time difference exceeds the threshold value, it is possible to constrain the transition between two first periods to within a prescribed range. Therefore, it is to be noted that the above-described effect, that it is possible to expand/compress audio signals while maintaining auditory naturalness, is remarkable.

Aspect 6

It a preferred example (Aspect 6) of any one of Aspects 2 to 5, in the time correspondence process, a minimum value of an allocation cost immediately preceding one of the plurality of second period is sequentially calculated as a basic cost for each of the plurality of second periods, and one of the plurality of first periods is made to correspond to each of the plurality of second periods so as to minimize the allocation cost in accordance with the basic cost of the immediately preceding one of the plurality of second periods, the similarity index, and the transition cost.

Aspect 7

In a preferred example (Aspect 7) of Aspect 6, in the time correspondence process, the basic cost is set for each of the plurality second periods such that one of the plurality of first period within a prescribed range corresponds to one of the plurality of second periods, based on a provisional relationship between each of the plurality of first periods and each of the plurality of second periods. In the aspect described above, the basic cost is set such that a first period corresponds to each of a plurality second periods within a prescribed range that corresponds to the second period, on the basis of a provisional relationship between each first period and each second period. Thus, it is possible to generate a second audio signal within a range that does not deviate widely from a provisional relationship between each first period and each second period.

Aspect 8

In a preferred example (Aspect 8) of Aspect 6 or 7, in the time correspondence process, the basic cost is set such that one of the plurality of first periods corresponding to a sound generation point of the first audio signal and one of the plurality of second period corresponding to the sound generation point based on a provisional relationship between each of the plurality of first periods and each of the plurality of second periods correspond to each other. In the aspect described above, the basic cost is set such that a first period corresponding to a sound generation point of a first audio signal and a second period corresponding to the sound generation point on the basis of a provisional relationship between each first period and each second period correspond to each other. That is, a second audio signal that reflects the time ratio between each sound generation point in the first audio signal (for example, a second audio signal in which the time ratio between each sound generation point is kept the same as in the first audio signal) is generated. Therefore, there is the benefit that it is possible to generate an audibly natural second audio signal in which the rhythm of the sound remains equal to that of the first audio signal.

Aspect 9

In a preferred example (aspect 9) of aspect 7 or 8, the provisional relationship is a linear relationship. In the aspect described above, there is the benefit that the provisional relationship is simplified.

Aspect 10

In a preferred example (aspect 10) of aspect 7 or 8, the provisional relationship is a curvilinear relationship. In the aspect described above, it is possible to make the first period and the second period correspond to each other by means of various types of relationships that are not limited to a linear relationship.

Aspect 11

In a preferred example (Aspect 11) of any one of Aspects 2 to 10, in the time correspondence process the transition cost to be applied to the time correspondence process is specified from a transition matrix whose elements are transition costs that correspond to combinations of the plurality of first periods.

Aspect 12

In a preferred example (Aspect 12) of any one of Aspects 2 to 10, in the time correspondence process, a transition cost to be applied to the time correspondence process is specified from a transition vector that corresponds to one column of a transition matrix whose elements are transition costs that correspond to combinations of each of the plurality of first periods. In the aspect described above, because the transition cost is specified from a transition vector that corresponds to one column of a transition matrix, it is not necessary to store an entire transition matrix. Therefore, there is the benefit that the storage capacity required for the time correspondence process can be reduced.

Aspect 13

An audio processing device according to a preferred aspect (Aspect 13) of the present invention comprises an electronic controller having a feature extraction unit and a signal generating unit. The feature extraction unit is configured to extract a feature quantity of a first audio signal for each of a plurality of periods. The signal generating unit is configured to generate a second audio signal by time axis expanding/compressing on a time axis either a section of the first audio signal in which the feature quantity is steadily maintained for a period time, or a section of the first audio signal in which a fluctuation of the feature quantity is repeated and excluding from the time axis expanding/compressing a section of the first audio signal in which a fluctuation of the feature quantity is not similar to that of other sections of the first audio signal. According to the configuration described above, for example, compared to a configuration in which the first audio signal is uniformly expanded/compressed over all the sections including both a steady section in which the feature quantity is steadily maintained and a transient section in which the feature quantity fluctuates unsteadily, it is possible to expand/compress the audio signal while maintaining auditory naturalness.

Aspect 14

An audio processing device according to a preferred aspect (Aspect 14) of the present invention comprises an electronic controller having a feature extraction unit, an index calculation unit, an analysis processing unit and a signal generating unit. The feature extraction unit is configured to extract a feature quantity of a first audio signal for each of a plurality of first periods; an index calculation unit is configured to calculate a similarity index of the feature quantity between each of the plurality of first periods. The analysis processing unit is configured to make the plurality of first periods correspond to a plurality of second periods within a target period after expansion/compression of the first audio signal in accordance with the similarity index and a transition cost for transitioning between each of the plurality of first periods. The signal generating unit is configured to generate a second audio signal over the target period from a result obtained upon the analysis processing unit making the plurality of first periods correspond to the plurality of second periods. In the aspect described above, a first period is made to correspond to each second period within the target period such that the allocation cost corresponding to the similarity index between each first period is minimized. That is, a section of the first audio signal in which the feature quantity is steadily maintained on the time axis and a section in which the fluctuation of the feature quantity is repeated are expanded/compressed on the time axis, and sections in which a fluctuation of the feature quantity does not resemble that of other sections are excluded from the subject of expansion/compression. Thus, for example, compared to a configuration in which the first audio signal is evenly expanded/compressed over all the sections including both a steady section in which a feature quantity is steadily maintained and a transient section in which the feature quantity fluctuates unsteadily, it is possible to expand/compress the audio signal while maintaining auditory naturalness. In addition, a first period is made to correspond to each second period within the target period in relation to the transition cost for transitioning between each of the first periods. Therefore, transitions between first periods that are excessively divergent on the time axis are restricted. Consequently, it is possible to realize the above-described effect of being able to expand/compress the audio signal while maintaining auditory naturalness.

What is claimed is:

1. An audio processing method comprising:

extracting a feature quantity of a first audio signal for each of a plurality of first periods;

calculating a similarity index of the feature quantity between each of the plurality of first periods;

executing a time correspondence process for making each one of the plurality of first periods substantially equal to a corresponding one of a plurality of second periods within a target period after expansion/compression of the first audio signal, in accordance with the similarity index and a transition cost for transitioning between each of the plurality of first periods, in the time correspondence process, a minimum value of an allocation cost immediately preceding one of the plurality of second periods being sequentially calculated as a basic cost for each of the plurality of second periods, and each of the plurality of first periods being made substantially equal to the corresponding one of the plurality of second periods so as to minimize the allocation cost in accordance with the basic cost of the immediately preceding one of the plurality of second periods, the similarity index, and the transition cost; and generating a second audio signal over the target period from a result obtained by making each one of the plurality of first periods substantially equal to the corresponding one of the plurality of second periods.

2. The audio processing method according to claim 1, wherein in the time correspondence process, the transition cost between two first periods from among the plurality of first periods is set to a first value when a time difference between the two first periods is below a threshold value and is set to a second value that is greater the first value when the time difference exceeds the threshold value.

3. The audio processing method according to claim 1, wherein in the time correspondence process, the basic cost is set for each of the plurality second periods such that each of the plurality of first periods within a prescribed range is made substantially equal to the corresponding one of the plurality of second periods based on a provisional relationship between each of the plurality of first periods and each of the plurality of second periods.

4. The audio processing method according to claim 3, wherein the provisional relationship is a linear relationship.

5. The audio processing method according to claim 3, wherein the provisional relationship is a curvilinear relationship.

6. The audio processing method according to claim 1, wherein in the time correspondence process, the basic cost is set such that one of the plurality of first periods corresponding to a sound generation point of the first audio signal, and one of the plurality of second periods corresponding to the sound generation point based on a provisional relationship between each of the plurality of first periods and each of the plurality of second periods, correspond to each other.

7. The audio processing method according to claim 6, wherein the provisional relationship is a linear relationship.

8. The audio processing method according to claim 6, wherein the provisional relationship is a curvilinear relationship.

9. The audio processing method according to claim 1, wherein in the time correspondence process, the transition cost to be applied to the time correspondence process is specified from a transition matrix whose elements are transition costs that correspond to combinations of the plurality of first periods.

10. The audio processing method according to claim 1, wherein in the time correspondence process, the transition cost to be applied to the time correspondence process is specified from a transition vector that corresponds to one column of a transition matrix whose elements are transition costs that correspond to combinations of each of the plurality of first periods.

11. An audio processing device comprising:

an electronic controller having a feature extraction unit, an index calculation unit, an analysis processing unit and a signal generating unit, the feature extraction unit being configured to extracting a feature quantity of a first audio signal for each of a plurality of first periods;

the index calculation unit being configured to calculate a similarity index of the feature quantity between each of the plurality of first periods;

the analysis processing unit being configured to make each of the plurality of first periods substantially equal to a corresponding one of a plurality of second periods within a target period after expansion/compression of the first audio signal in accordance with the similarity index and a transition cost for transitioning between each of the plurality of first periods, the analysis processing unit being configured to sequentially calculate a minimum value of an allocation cost immediately preceding one of the plurality of second periods as a basic cost for each of the plurality of second periods, and configured to make each of the plurality of first periods substantially equal to the corresponding one of the plurality of second periods so as to minimize the allocation cost in accordance with the basic cost of the immediately preceding one of the plurality of second periods, the similarity index, and the transition cost; and the signal generating unit being configured to generate a second audio signal over the target period from a result obtained upon the analysis processing unit making each of the plurality of first periods substantially equal to the corresponding one of the plurality of second periods.

12. The audio processing device according to claim 11, wherein the analysis processing unit is configured to set the basic cost for each of the plurality second periods such that each of the plurality of first periods within a prescribed range is made substantially equal to the corresponding one of the plurality of second periods based on a provisional relationship between each of the plurality of first periods and each of the plurality of second periods.

13. The audio processing device according to claim 12, wherein the provisional relationship is a linear relationship.

14. The audio processing device according to claim 12, wherein the provisional relationship is a curvilinear relationship.

15. The audio processing device according to claim 11, wherein the analysis processing unit is configured to set the basic cost such that one of the plurality of first periods corresponding to a sound generation point of the first audio signal, and one of the plurality of second periods corresponding to the sound generation point based on a provisional relationship between each of the plurality of first periods and each of the plurality of second periods, correspond to each other.

16. The audio processing device according to claim 15, wherein the provisional relationship is a linear relationship.

17. The audio processing device according to claim 15, wherein the provisional relationship is a curvilinear relationship.

* * * * *